United States Patent [19]

LaBate

[11] 3,934,862

[45] Jan. 27, 1976

[54] DEVICE FOR SUPPLYING A TREATING AGENT TO MOLTEN METAL IN A LADLE

[76] Inventor: Micheal Donald LaBate, 115 Hazen Ave., Ellwood City, Pa. 16117

[22] Filed: June 13, 1974

[21] Appl. No.: 480,141

Related U.S. Application Data

[63] Continuation-in-part of Ser. No. 347,556, April 12, 1973, abandoned.

[52] U.S. Cl. ..... 266/34 T; 75/53

[51] Int. Cl.[2] ..... C21C 7/00

[58] Field of Search ..... 75/48, 53–58, 75/93 A, 93 G; 266/34 T

[56] References Cited

UNITED STATES PATENTS

| | | | |
|---|---|---|---|
| 2,005,540 | 6/1935 | Fleming et al. | 266/34 T |
| 2,809,886 | 10/1957 | Klingbeil | 266/34 T |
| 2,915,386 | 12/1959 | Strauss | 75/93 |
| 3,231,368 | 1/1966 | Watson et al. | 75/58 |
| 3,322,530 | 5/1967 | Nakamura | 75/53 |
| 3,446,268 | 5/1969 | Horsley | 266/34 T X |
| 3,681,050 | 8/1972 | Ueki | 75/58 |
| 3,681,051 | 8/1972 | Takashima et al. | 75/58 |
| 3,784,177 | 1/1974 | Rocher et al. | 266/34 T |

*Primary Examiner*—Gerald A. Dost
*Attorney, Agent, or Firm*—Webster B. Harpman

[57] ABSTRACT

A ladle for receiving molten metal is equipped with a device incorporating consumable components, the disintegration time of which may be predetermined, which holds a treating agent for the molten metal and is adapted to be submerged in the ladle and retained therein by the weight of the same.

5 Claims, 2 Drawing Figures

FIG. 1
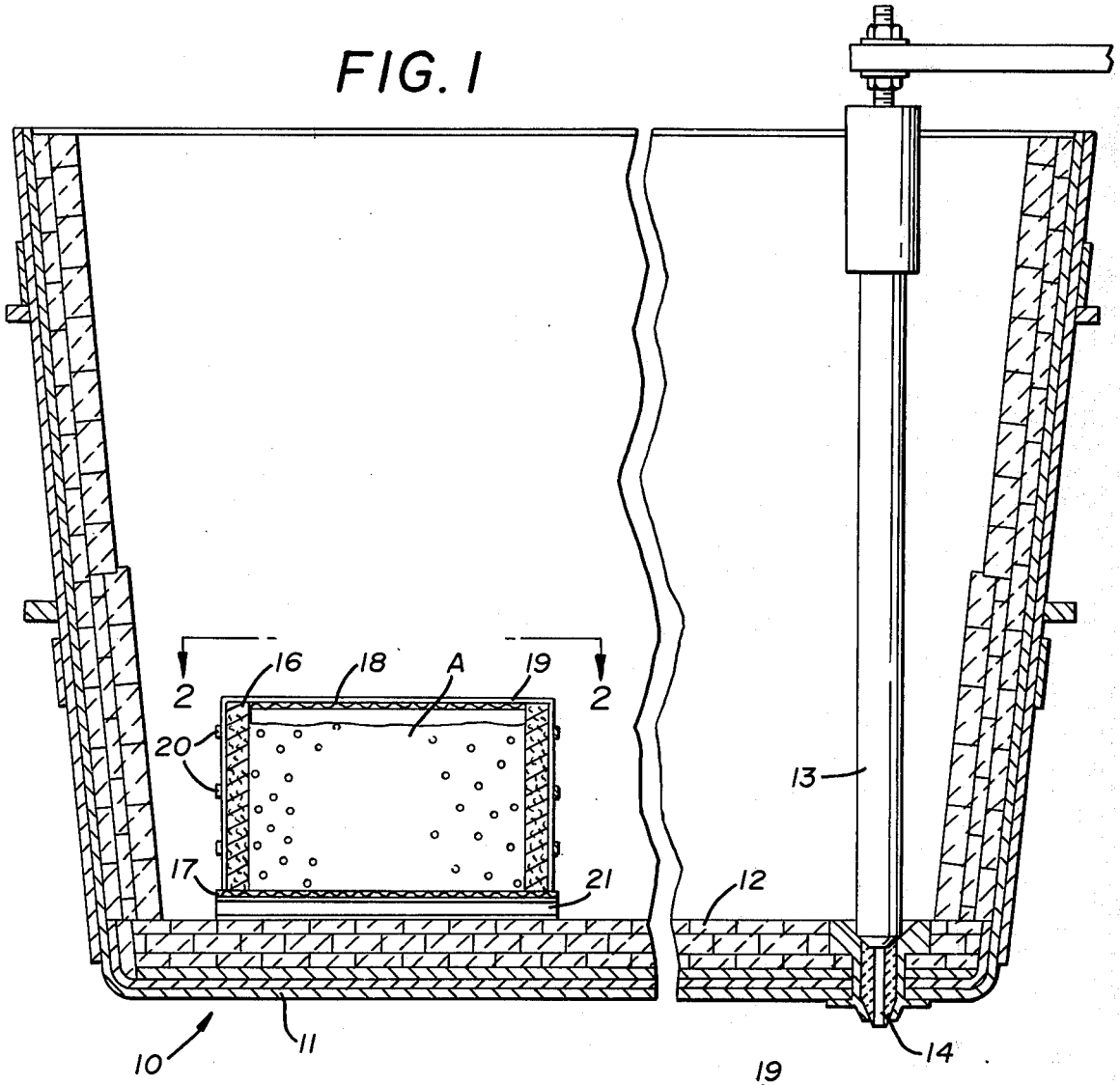
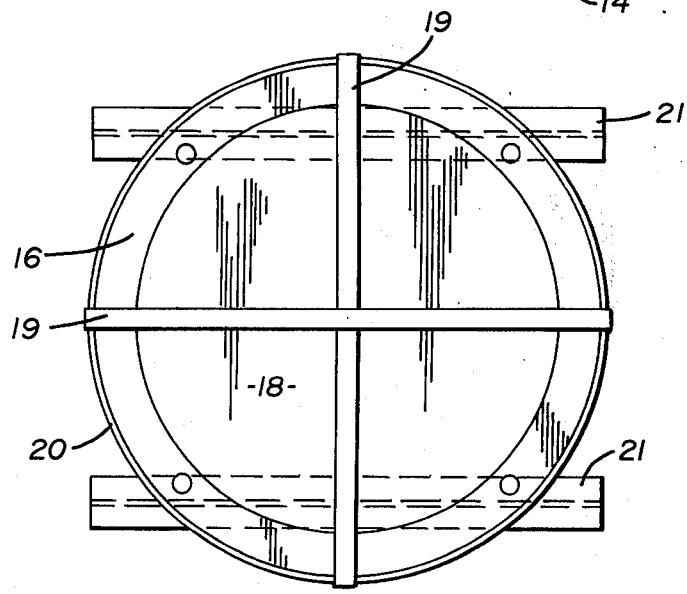
FIG. 2

DEVICE FOR SUPPLYING A TREATING AGENT TO MOLTEN METAL IN A LADLE

This is a continuation-in-part of my application Ser. No. 347,556, filed Apr. 12, 1973, now abandoned.

BACKGROUND OF THE INVENTION

1. Field of the Invention

This invention relates to ladle additions and devices for supplying treating agents to molten metal in such ladles and wherein said devices are submerged in the molten metal and arranged to release the treating agents in a desirable area of the molten metal and during a desirable time period.

2. Description of the Prior Art

The prior art devices include cylindrical members having a plurality of transverse partitions therein dividing the same into vertically arranged chambers in which various treating agents may be positioned for the sequential release into molten metal as disclosed in U.S. Pat. No. 2,915,386. U.S. Pat. Nos. 3,168,608 and 2,005,450 disclose other devices for the purpose and U.S. Pat. No. 3,681,051 shows addition agents. U.S. Pat. No. 3,784,177 shows a ladle and an addition agent device therein.

This invention introduces a treating into the molten metal by providing a novel container and anchoring structure which insure the positioning of the treating agent in a desired location in the molten metal and the timed rate of release of the treating agent therefrom.

SUMMARY OF THE INVENTION

A device for supplying a treating agent to molten metal consists of a nonmetallic consumable container or cylinder filled with the treating agent and having top and bottom non-metallic consumable closures and attached to a metal base for positioning in the bottom of an iron ladle having a puddle of molten iron therein to which the metal base will freeze. Subsequent filling of the ladle with molten iron results in the predetermined, timed disintegration of the device and the release of the treating agent into the molten iron in a most desirable location and at an advantageous rate.

DESCRIPTION OF THE DRAWINGS

FIG. 1 is a section through a ladle equipped with the new device.

FIG. 2 is a top plan view of the device.

DESCRIPTION OF THE PREFERRED EMBODIMENT

By referring to the drawings in FIG. 1 in particular it will be seen that a standard ladle 10 having a metal casing 11, a refractory lining 12, a bottom aperture 13 and a stopper rod 14 terminating in a stopper nozzle 15 is illustrated and includes a device for holding the addition agent, the device consists of a cylinder 16 formed of non-metallic consumable disintegratable material having a wall thickness chosen to provide a predetermined time of consumption or disintegration when the same is covered by molten metal in the ladle 10. The cylinder 16 is provided with a bottom 17 and a top 18, both of which are circular discs of consumable material such as cardboard or the like. The interior of the cylinder 16 is filled with a treating agent A and a plurality of steel straps 19 are positioned around the cylinder 16 so as to enclose the bottom and top portions 17 and 18 respectively, and arranged with the vertical sections of the straps 19 in spaced circumferential relation about the cylinder 16. The ends of the straps are attached to one another in a manner known in the art. A second series of steel straps 20 are positioned around the cylinder 16 in horizontal arrangement and in spaced vertical relation so as to overlap the first series of straps 19 heretofore referred to. The ends of the straps 20 are attached to one another.

Still referring to FIG. 1 of the drawings, it will be observed that the lower ends of some of the straps 19 are secured to a base frame 21 which is composed of at least a pair of spaced parallel I-beams which are disposed beneath the bottom 17 and attached to the device of the invention by the straps 19. Alternately, the straps 19 may be passed beneath the I-beams 21 or positioned through apertures therein so long as the arrangement is such that the cylinder 16 and its bottom and top portions 17 and 18 respectively are secured thereto as hereinbefore disclosed.

If desired, spacing members can be positioned between the spaced parallel I-beams 21 so as to hold the same in position while the steel bands 19 are installed.

The resulting device when positioned in a puddle of metal in the ladle 10 will freeze thereto and thus become securely positioned on the bottom of the ladle 10. The thickness of the I-beams 21 is such that the treating agent A is located above the actual bottom of the ladle 10 and enclosed in the consumable material whereby filling the ladle with molten metal results in properly locating the device submerged in the molten metal. The thickness and composition of the cylinder 16 and the bottom and top portions 17 and 18 respectively is such that a predetermined timed release of the treating agent A is obtained in the desirable location in the molten metal. For example a desulphurizing agent is thus advantageously located in the ladle and the release of the agent by the device of the invention insures the complete and desirable desulphurization of the metal.

The non-metallic material from which the cylinder 16 is formed is preferably a mixture wherein a batch consists of 122 lbs. of dolomite, 16 lbs. of wood chips and 10 lbs. of a hydrocarbon resin binder and catalyst therefore such as known in the art as a two part oil classification polyester resin and a polyisocyanate catalyst available under the trademarks DEEP SET BINDER CM 2.5 and DEEP SET CATALYST FS 100, manufactured by United-Erie, Inc. of Erie, Pennsylvania 16512.

An alternate composition would comprise 132 lbs. of limestone substituted for the dolomite, an equal amount of wood flour or rice hulls substituted for the wood chips and wherein the total amount of the oil class binder and catalyst would vary from 4 lbs. to 10 lbs.

The foregoing mixture of the non-metallic consumable, disintegratable material will when properly formed into the desired shapes and dried and assembled as hereinbefore described into the device of the invention, be consumed or disintegrate at a constant predetermined rate without any gas build up and thereby insure the desired time and rate of release of the treating agent under desirable conditions.

It will be observed by those skilled in the art that the spaced parallel base members 21 are preferably assembled to the bottom 17 and the cylinder 16 positioned thereon. The treating agent A is then positioned in the cylinder 16, the top 18 installed and the straps 19 and 20 affixed, the device is then lowered into position in the ladle 10. The weight of the device is approximately 1½ times that of molten iron displaced thereby and the same will therefore retain its position on the bottom of a ladle so that filling the same with molten iron will result in the location of the treating agent A where it is most effective in treating the molten iron. The formation of the device of metal parts and non-metallic consumable parts enable the same to effectively locate, hold and control the rate of discharge of the treating agent.

It will thus be seen that a device for supplying a treating agent to molten metal at a desirable location therein and during a predetermined time period has been disclosed which will act effectively for the intended purpose. The weight of the device is approximately 1½ times the weight of the molten metal displaced thereby and the arrangement is such that initially positioning the device in the ladle in a puddle of molten iron therein will insure freezing of the same thereto all of which will preclude floating of the device and the treating agent when the ladle is filled with molten iron.

Although but one embodiment of the present invention has been illustrated and described, it will be apparent to those skilled in the art that various changes and modifications may be made therein without departing from the spirt of the invention.

Having thus described my invention, what I claim is:

1. A refractory lined apertured ladle for making additions to molten metal, said ladle including a refractory lined apertured bottom and an upstanding, refractory lined side wall peripherally of the bottom, means closing the aperture in the bottom, and a hollow, heat consumable-disintegratable container supported in the ladle and having an addition agent confined therewithin, said container comprising a body having top and bottom open ends and made of a mixture comprising about 132 lbs. of a material selected from the group consisting essentially of limestone and dolomite, about 16 lbs. of a material selected from the group consisting essentially of wood chips, wood flour, and rice hulls, and from 4 lbs. to 10 lbs. of a hydrocarbon resin binder and a catalyst for the binder, a preselected portion of the resin binder and catalyst and the material selected from the group consisting essentially of wood chips, wood flour, and rice hulls comprising a combustible material to provide for the comsumption of the container at a predetermined rate to prevent boiling and agitation of the molten metal and thus to insure proper timed release of the addition agent into the molten metal, closure means closing the top and bottom ends of the body, and spacer means on the bottom of the container supporting the container in the ladle in predetermined spaced relation from the bottom of the ladle for proper positioning of the addition agent in the molten metal in the ladle, said spacer means having a weight sufficient to hold the container submerged in the molten metal and defining means for freezing of the container to the ladle bottom.

2. A ladle as in claim 1, wherein the closure means on the top and bottom ends of the body are consumable.

3. A ladle as in claim 1, wherein the binder is a two-part oil classification polyester resin and the catalyst is a polyisocyanate.

4. A ladle as in claim 1, wherein the spacer means is metal and weighs more than the molten metal it displaces.

5. A ladle as in claim 4, wherein the spacer means comprises a pair of spaced apart I-beams attached to the bottom of the container.

* * * * *